US008143775B2

(12) United States Patent
Hu

(10) Patent No.: US 8,143,775 B2
(45) Date of Patent: Mar. 27, 2012

(54) TWO-WAY RECIPROCAL AMPLIFICATION ELECTRON/PHOTON SOURCE

(75) Inventor: Qiu-Hong Hu, Göteborg (SE)

(73) Assignee: Lightlab Sweden AB, Saltsjobaden (SE)

( * ) Notice: Subject to any disclaimer, the term of this patent is extended or adjusted under 35 U.S.C. 154(b) by 530 days.

(21) Appl. No.: 11/922,354

(22) PCT Filed: Jun. 28, 2006

(86) PCT No.: PCT/EP2006/006241
§ 371 (c)(1),
(2), (4) Date: May 5, 2008

(87) PCT Pub. No.: WO2007/003316
PCT Pub. Date: Jan. 11, 2007

(65) Prior Publication Data

US 2009/0128002 A1 May 21, 2009

(30) Foreign Application Priority Data

Jun. 30, 2005 (EP) ..... 05105939

(51) Int. Cl.
*H01J 1/62* (2006.01)

(52) U.S. Cl. ..... 313/493; 313/491; 313/495; 313/496; 313/501; 313/503

(58) Field of Classification Search ..... 313/495–498
See application file for complete search history.

(56) References Cited

U.S. PATENT DOCUMENTS 2,296,643 A 9/1942 Leverenz
2,763,814 A 9/1956 Navarre
3,778,662 A 12/1973 Johnson
3,937,998 A 2/1976 Verstegen et al.
4,266,161 A 5/1981 Kasenga et al.
(Continued)

FOREIGN PATENT DOCUMENTS

EP 1 542 260 6/2005
(Continued)

OTHER PUBLICATIONS

Machine English translation of JP 08127769 to Toki et al.—disclosure.*
Machine English translation of JP 08127769 to Toki et al.—claims.*

*Primary Examiner* — Sikha Roy
(74) *Attorney, Agent, or Firm* — Harness, Dickey & Pierce, P.L.C.

(57) ABSTRACT

In one embodiment of the present invention, an electron/photon source is disclosed based on field emission, cathodoluminescent and photo-enhanced field emission, including an evacuated chamber inside a housing, further including an anode and a cathode arranged inside the evacuated chamber. Furthermore, the cathode is arranged to emit electrons when a voltage is applied between the anode and cathode, the anode being arranged to emit light at a first wavelength range when receiving electrons emitted from the cathode, and a wavelength range converting material arranged to receive the emitted light of the first wavelength range and emit light at a second wavelength range. In a novel way, an embodiment of the present invention makes it possible to, in two steps, convert the electrons emitted from the cathode to visible light. The invention has shown to be advantageous, and makes it possible to select new emission materials, manufactured at a fraction of the cost associated with the earlier used materials where the electron to visible light conversion was done in one step.

16 Claims, 3 Drawing Sheets

U.S. PATENT DOCUMENTS

| | | | | |
|---|---|---|---|---|
| 4,791,336 | A | 12/1988 | Morimoto et al. | |
| 4,818,914 | A * | 4/1989 | Brodie | 315/169.3 |
| 5,747,100 | A | 5/1998 | Petersen | |
| 5,821,685 | A * | 10/1998 | Peterson | 313/467 |
| 6,573,643 | B1 | 6/2003 | Kumar et al. | |
| 6,873,095 | B1 * | 3/2005 | Kjellman et al. | 313/336 |
| 2002/0057059 | A1 * | 5/2002 | Ogishi et al. | 313/636 |
| 2002/0070648 | A1 * | 6/2002 | Forsberg | 313/309 |
| 2004/0095061 | A1 * | 5/2004 | Yamada et al. | 313/495 |
| 2004/0135154 | A1 | 7/2004 | Doxsee et al. | |

FOREIGN PATENT DOCUMENTS

| | | | |
|---|---|---|---|
| GB | 2 032 683 | | 5/1980 |
| JP | 60-227350 | | 11/1985 |
| JP | 60-227351 | | 11/1985 |
| JP | 08127769 | A * | 5/1996 |
| JP | 2003-277748 | | 10/2003 |
| WO | WO 97/07531 | | 2/1997 |
| WO | WO 2004/027818 | | 4/2004 |

* cited by examiner

TWO-WAY RECIPROCAL AMPLIFICATION ELECTRON/PHOTON SOURCE

TECHNICAL FIELD

The present invention relates to an electron/photon source comprising an evacuated chamber inside a housing. The present invention also relates to a corresponding method for manufacturing such an electron/photon source.

TECHNICAL BACKGROUND

The technology used in modern energy saving lighting devices uses mercury as one of the active components. As mercury harms the environment, extensive research is done to overcome the complicated technical difficulties associated with energy saving, mercury-free lighting.

An approach used for solving this problem is by using field emission light source technology. Field emission is a phenomenon which occurs when an electric field proximate to the surface of an emission material narrows a width of a potential barrier existing at the surface of the emission material. This allows a quantum tunneling effect to occur, whereby electrons cross through the potential barrier and are emitted from the material.

In prior art devices, a cathode is arranged in an evacuated chamber, having for example glass walls, wherein the chamber on its inside is coated with an anode electrically conductive layer. Furthermore, a light emitting layer is deposited on the anode conductive layer. When a potential difference is applied between the cathode and the anode conductive layer, electrons are emitted from the cathode, and accelerated towards the anode conductive layer. As the electrons strike the light emitting layer, they cause it to emit photons, a process referred to as cathodoluminescence, which is different from photoluminescence which is employed in conventional fluorescent lighting devices, such as conventional fluorescent tubes.

Such a device is disclosed in U.S. Pat. No. 6,573,643, wherein the anode conductive layer for example can be composed of indium-tin oxide and the light emitting layer is composed of phosphorescent material. This phosphorescent material receives electrons from a cathode and emits photons at a visible wavelength.

Such a phosphorescent material that receives electrons and emits photons at a visible wavelength is very expensive and difficult to manufacture, resulting in expensive lighting devices.

It is therefore an object of the present invention to provide a novel and improved field emission light source that provides a solution to some of the above mentioned problems.

SUMMARY OF THE INVENTION

The above need is met by an electron/photon source based on field emission, cathodoluminescence and photo-enhanced field emission, and a corresponding method for manufacturing such an electron/photon source as defined in independent claims 1 and 15. The dependent claims define advantageous embodiments in accordance with the present invention.

According to a first aspect thereof, the present invention provides an electron/photon source comprising an evacuated chamber inside a housing, further comprising an anode and a cathode arranged inside said evacuated chamber. Furthermore, the cathode is arranged to emit electrons when a voltage is applied between the anode and cathode, said anode being arranged to emit light at a first wavelength range when receiving electrons emitted from said cathode, and a wavelength range converting material arranged to receive said emitted light of said first wavelength range and emit light at a second wavelength range.

In a novel way, this first aspect of the present invention makes it possible to, in two steps, convert the electrons emitted from the cathode to visible light. The first step consists of converting electrons to light at a first wavelength range, whereas the second step consists of converting said light of said first wavelength range to a second wavelength range. This is especially advantageous and makes it possible to select new emission materials, manufactured at a fraction of the cost associated with the in prior art used materials where the electron to visible light conversion was done in one step. The expression wavelength range is understood to be a wavelength range wherein a majority, e.g. 80%, of the light content is located. This wavelength range has a lower starting point and an upper ending point. In the same way, the term wavelength converting material is understood to be an emission material converting light from a first wavelength range to a second wavelength range when receiving light at said first wavelength range.

In a preferred embodiment of the present invention, the anode is further composed by a transparent substrate on one side covered by a transparent electrically conducting material sandwiched between said substrate and an emission material. As an example, the emission material will emit light when receiving electrons from the cathode at the first wavelength range which is at about 100 nm to 400 nm, more preferably at about 200 nm to 400 nm and most preferably at about 250 nm to 400 nm. The second wavelength range is preferably at about 350 nm to 900 nm, more preferably at about 400 nm to 800 nm and most preferably at about 450 nm to 650 nm. This generally means that the emission material arranged on the anode in the first step will emit ultra-violet light, which is received by the wavelength range converting material which converts the ultra-violet light to light visible for the human eye.

The transparent electrically conductive material can be selected from a wide range of material, but it is preferred to use one of Indium-Tin Oxide (ITO) or Zinc-Oxide (ZnO) or even single wall carbon nanotubes, because of these transparent materials advantageous conductivity capabilities, even when the applied layer is in the interval of 100 nm to 1000 nm.

In another preferred embodiment of the present invention the emission material is ZnO. The use of ZnO has shown to be more advantageous since the room temperature cathodoluminescence spectra of ZnO has a strong intensity peak at about 380 nm and has a 80% light content within +/−20 nm. As an extra feature the use of ZnO has shown excellent results when used as a cathode in a field emission light source due to the possibility to grow ZnO nanotips at relatively low temperatures. This means that it is possible to construct both the anode and the cathode as interchangeable components. This will greatly reduce the manufacturing cost of the light source. Furthermore, it is preferred to use the red green blue phosphors most sensitive to 380 nm as the wavelength range converting materials. As an alternative a blend of blue yellow phosphors could be used.

As understood by the person skilled in the art, there are three advantageous ways of arranging the wavelength range converting material in the electron/photon source. The first is by covers the inside of the housing, the second is by covering the outside of the evacuated chamber, and the third is by sandwiching the wavelength range converting material between the substrate and the transparent electrically conducting material. The arrangement of the wavelength range converting material is feasible using any of the three above described ways, and are hence implemented according to the design of the light source.

In yet another preferred embodiment of the present invention the transparent substrate is one of glass, quartz or plastics. The use of quartz and has shown advantageous results in experimental trials since the quartz is highly transparent to the said UV light, whereas the use of plastics will cut the material and manufacturing costs.

A another aspect of the present invention provides a lighting system comprising either a direct current or alternating current control electronics and a field emission light source according to the above described embodiments. A lighting system can be either an enclosed unit or an arrangement comprising the mentioned components.

Yet another aspect of the present invention provides a method for manufacturing an electron/photon source, preferably a field emission light source, comprising the steps of providing an evacuated chamber inside a housing, arranging an anode and a cathode inside of said evacuated chamber, and arranging, inside of said field emission light source, a wavelength range converting material arranged to receive light of a first wavelength range emitted from said anode and emit light at a second wavelength range. As described above in relation to the first aspect of the present invention, this method provides an advantageous possibility to select new emission materials, manufactured at a fraction of the cost associated with the in prior art used materials where the electron to visible light conversion was done in one step.

Further features of, and advantages with, the present invention will become apparent when studying the appended claims and the following description. Those skilled in the art realize that different features of the present invention can be combined to create embodiments other than those described in the following.

BRIEF DESCRIPTION OF THE DRAWINGS

The present invention will now be described in more detail with reference to the accompanying drawings, in which.

DETAILED DESCRIPTION OF THE PREFERRED EMBODIMENT

Figure 1:
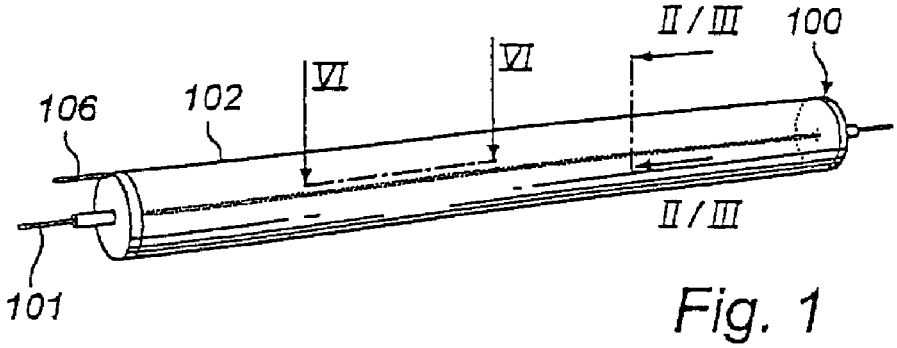
Fig. 1 (Prior Art)
FIG. 1 illustrates a side view of a field emission fluorescent tube.

FIG. 1 illustrates a prior art field emission fluorescent tube 100 wherein a cathode 101 is surrounded by a tube 102. An anode (not shown) is connected to a electric contact 106.

Figure 2:
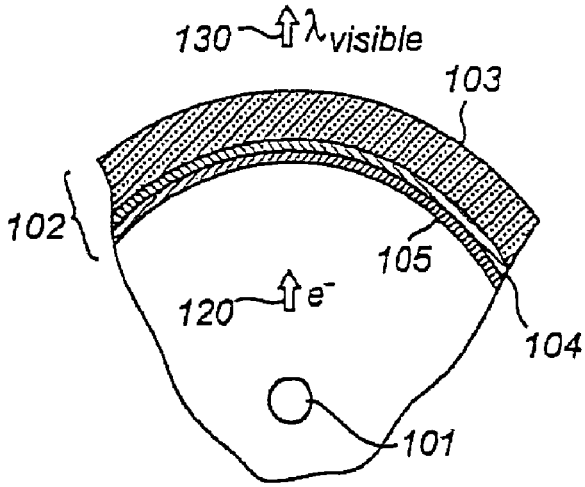
Fig. 2 (Prior Art)
FIG. 2 illustrates a partial cross section of a prior art field emission fluorescent tube.

A partial cross section of the prior art field emission fluorescent tube 100 is shown in FIG. 2. The tube 102 consists of a glass structure 103 and a transparent and electrically conducting anode layer 104 which is sandwiched between the glass structure 103 and an emission layer 105. The electrically conducting anode layer is connected to an electric contact 106. Furthermore, the emission layer 105 is caused to be luminescent with light at a visible wavelength 130 when being hit by electrons 120 caused by a potential difference between the electrically conductive layer 104 and the cathode 101.

Figure 3:
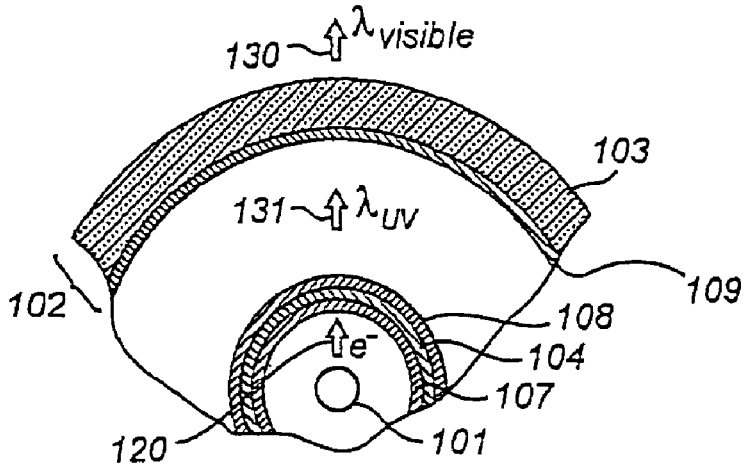
FIG. 3 illustrates a partial cross section of the electron/photon source according to an embodiment of the present invention.

In FIG. 3, a partial cross section of the field emission fluorescent tube in FIG. 1, showing a preferred embodiment according to the present invention. Again a cathode 101 is shown together with a transparent and electrically conducting anode layer 104. The cathode materials can be for instance, but is not limited to, sharp tips of ZnO or carbon nanotubes. The transparent and electrically conducting anode layer 104 is sandwiched between an emission material 107 and a transparent substrate 108. The transparent substrate 108 acts as an enclosed chamber which is evacuated.

When a potential difference occurs between the cathode 101 and the anode layer 104, the emission material 107 is being hit by electrons 120 from the cathode 101 and caused to emit light at a first wavelength 131, such as within the ultraviolet wavelength range (generally about 200 nm to 400 nm). The light at the first wavelength 131 travels through the transparent substrate 108 and will bombard a wavelength range converting material 109, causing the wavelength range converting material 109 to emit light at a second wavelength 130, preferably with a visible wavelength, such as within the range of about 400 nm to 700 nm. In a preferred embodiment of the present invention, the transparent electrically conducting layer 104 is made of Indium Tin Oxide (ITO) and the transparent substrate 108 is made of quartz.

Figure 4:
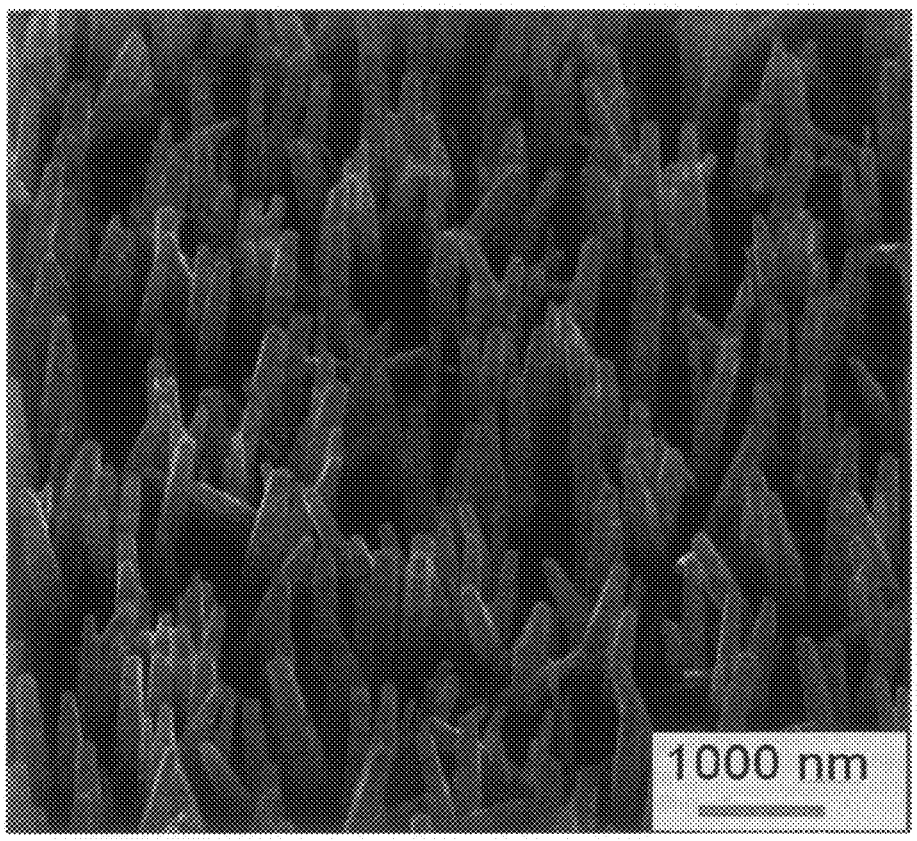
FIG. 4 illustrates a field emission scanning electron microscope image of ZnO nanotips.
Figure 5:
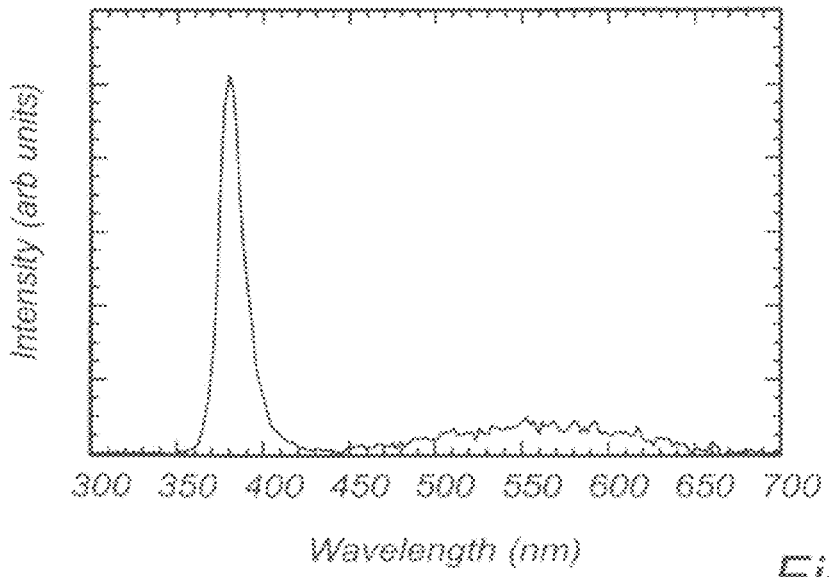
FIG. 5 illustrates the cathodoluminescence spectrum of the ZnO nanotips.

As mentioned earlier, ZnO is a particularly advantageous alternative when selecting the emission material 107, since it will emit light at about 380 nm when being hit by electrons. This makes the selection of wavelength range converting material 109 easier. Turning now to FIG. 4, wherein a field emission scanning electron microscope image of ZnO nanotips on sapphire is shown. The tips are sharp with a dense distribution. Furthermore, FIG. 5 shows the cathodoluminescence spectrum of the ZnO nanotips. As can be seen, a strong peak is observed at about 380 nm. The person skilled in the art will understand that the shown nanotips structure with its exact tips can be advantageous when constructing a field emission light source where the anode and the cathode are interchangeable components.

Figure 6:
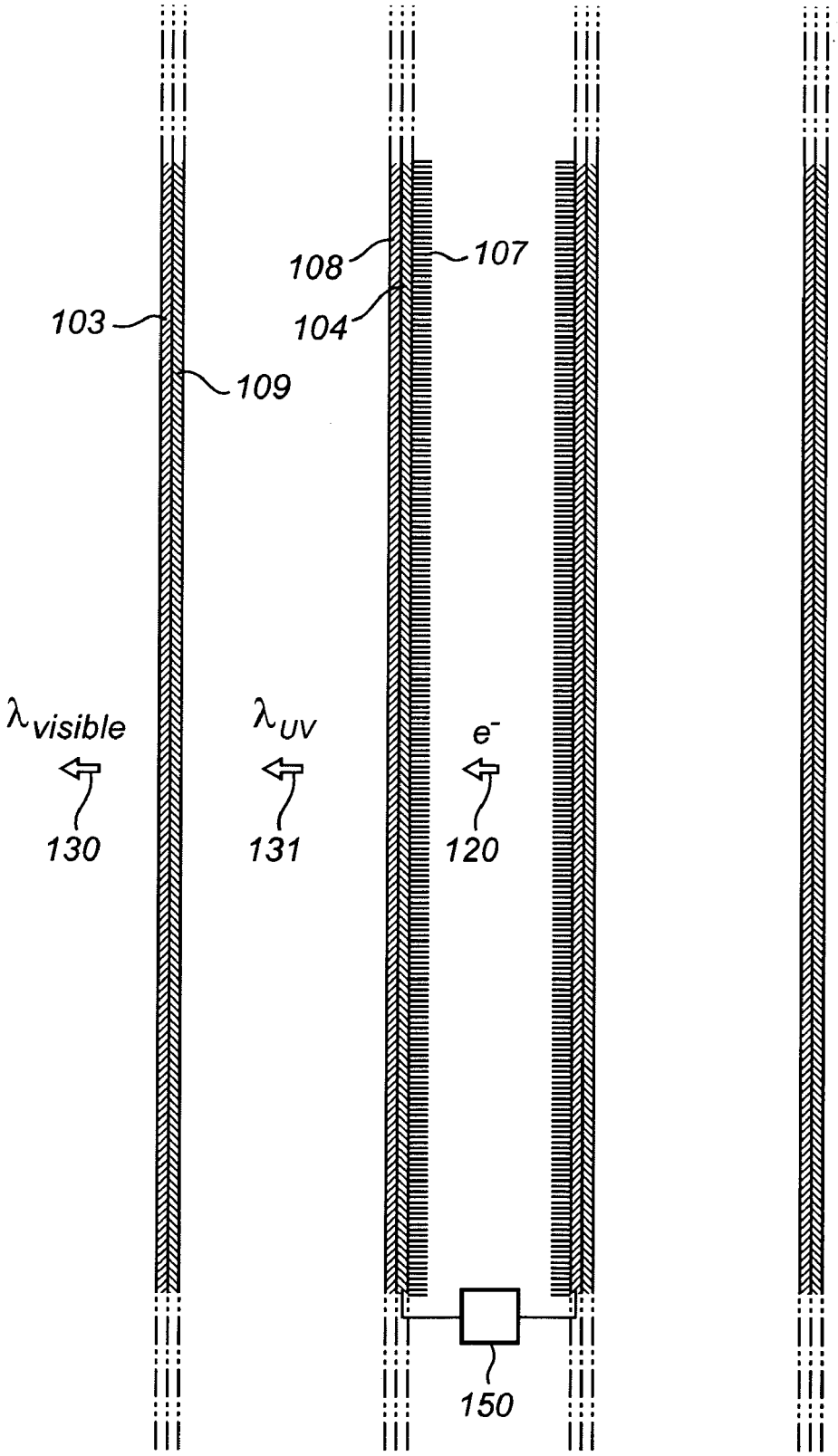
FIG. 6 illustrates a partial cross section according to another embodiment of the present invention.

Such a design is shown in FIG. 6. This embodiment of the present inventions is also shown as a tube structure, but can of course be of any feasible shape of lighting device design, wherein a wavelength range converting material 109 has been arranged on the outer walls 103 which are preferably made of glass and forming a shielding housing. An evacuated chamber is formed by a transparent substrate 108, wherein on the inside it has been deposited, as two electrically isolated segments, two interchangeable anode/cathode components. These two components each consists of a transparent electrically conducting layer on which is grown ZnO nanotips 107 as shown in FIG. 4. The two isolated components act as an anode or a cathode depending on the applied polarity of the voltage (from the power source 150). The functionality of the design as shown in FIG. 6 is coincident with the two step light conversion functionality of the design as shown in FIG. 3. As understood by the person skilled in the art when discussing the basic physics behind the invention, when a negative high electric field is produced on the cathode, field emission will take place. These electrons will hit the wavelength converting material and produce UV photons. The forward emitted UV photons will carry out the wavelength conversion, whereas the backward emitted UV photons will hit the cathode and cause photo-enhanced field emission. Hence, the structure as shown in FIG. 6 will not only emit photons from the ZnO nanotips 107 (which currently acts as the anode) to the wavelength range converting material 109, but also "help" the currently acting cathode to emit more electrons (when being hit by light (photons) emitted from the ZnO nanotips 107), thereby working as an amplifier, and hence forming a two-way reciprocal amplification electron/photon source.

In yet another embodiment of the present invention, the power source 150 can be a high frequency power source, wherein for instance 107 on both sides (see FIG. 6) can act as the anode or the cathode alternatively, depending on the polarity associated with the alternating current source.

Although the present invention and its advantages have been described in detail, is should be understood that various changes, substitutions and alternations can be made herein without departing from the spirit and scope of the invention as defined by the appended claims. For example the invention is not limited to the tube structure as described in the preferred embodiments, but can for example be designed as a bulb or any other shape of present or future lighting source structure.

The invention claimed is:

1. A field emission light source comprising:

a wavelength range converting material;

an evacuated chamber arranged inside a housing, thereby forming a double wall structure; and an anode and a cathode arranged inside said evacuated chamber, wherein said cathode is arranged to emit electrons when a voltage is applied between said anode and said cathode, said anode is arranged to emit light at a first wavelength range when receiving electrons emitted from said cathode, said wavelength range converting material is arranged to receive said emitted light of said first wavelength range and to emit light at a second wavelength range, said first wavelength range is about 100 nm to 450 nm, said second wavelength range is about 350 nm to about 900 nm, said anode is composed of a transparent substrate on one side covered by a transparent electrically conducting material sandwiched between said substrate and an emission material, and said wavelength range converting material is separated from said transparent substrate.

2. A field emission light source according to claim 1, wherein said cathode is configured to emit said electrons upon application of a voltage between said cathode and said transparently electrically conducting material of said anode, and said emission material of said anode is configured to emit light at said first wavelength range when receiving electrons from said cathode.

3. A field emission light source according to claim 2, wherein said emission material is ZnO.

4. A field emission light source according to claim 2, wherein said transparent substrate is one of glass, quartz or plastics.

5. A field emission light source according to claim 2, wherein said transparent electrically conducting material is one of ITO, ZnO or single wall carbon nanotubes.

6. A field emission light source according to claim 2, wherein said transparent substrate constitute the walls of said evacuated chamber.

7. A field emission light source according to claim 1, wherein said anode and said cathode are similar interchangeable components.

8. A field emission light source according to claim 1, wherein said wavelength range converting material covers the inside of said housing.

9. A field emission light source according to claim 1, wherein said wavelength range converting material covers the outside of said evacuated chamber.

10. A field emission light source according to claim 1, wherein said wavelength range converting material is a blend of red, green, and blue phosphors or a blend of blue yellow phosphors.

11. A lighting system comprising direct current or alternating current control electronics and field emission light source according to claim 1.

12. A field emission light source according to claim 1, wherein said first wavelength range is at about 250 nm to 420 nm.

13. A field emission light source according to claim 1, wherein said second wavelength range is at about 400 nm to 800 nm.

14. A field emission light source according to claim 1, wherein said second wavelength range is at about 450 nm to 650 nm.

15. A field emission light source comprising:

a double wall structure including an evacuated chamber inside a housing;

an anode including a transparent substrate inside the evacuated chamber, the transparent substrate on one side covered by a transparent electrically conducting material, the transparent electrically conducting material between the transparent substrate and an emission material;

a cathode inside the evacuated chamber, the cathode to emit electrons upon application of a voltage between the anode and the cathode, the anode to emit light at a first wavelength range upon receiving electrons emitted from the cathode; and a wavelength range converting material to receive the emitted light of the first wavelength range and to emit light at a second wavelength range, the wavelength range converting material being separated from the transparent substrate.

16. A field emission light source comprising:

a double wall structure including an evacuated chamber inside a housing;

an anode including a substrate inside the evacuated chamber, the substrate on one side covered by an electrically conducting material, the electrically conducting material between the substrate and an emission material;

a cathode inside the evacuated chamber, the cathode to emit electrons upon application of a voltage between the anode and the cathode, the anode to emit light at a first wavelength range upon receiving electrons emitted from the cathode; and a wavelength range converting material to receive the emitted light of the first wavelength range and to emit light at a second wavelength range, the wavelength range converting material being separated from the substrate.

* * * * *